US006729136B2

(12) United States Patent
Dakhil

(10) Patent No.: US 6,729,136 B2
(45) Date of Patent: May 4, 2004

(54) LIQUID METAL/LIQUID NITROGEN POWER PLANT FOR POWERING A TURBINE OR ANY USE DEVICE

(76) Inventor: Farouk Dakhil, Viale R. Belloni 56, Rome (IT)

( * ) Notice: Subject to any disclaimer, the term of this patent is extended or adjusted under 35 U.S.C. 154(b) by 0 days.

(21) Appl. No.: 10/174,671

(22) Filed: Jun. 18, 2002

(65) Prior Publication Data

US 2003/0230087 A1 Dec. 18, 2003

(51) Int. Cl.[7] ..... F02G 1/00; F01K 25/00; B60K 3/00

(52) U.S. Cl. ..... 60/650; 60/651; 60/671; 60/682; 180/302

(58) Field of Search ..... 60/650, 651, 671, 60/682; 180/302

(56) References Cited

U.S. PATENT DOCUMENTS 3,987,632 A * 10/1976 Pereda ..... 60/671
4,327,553 A * 5/1982 Rilett ..... 60/671
5,960,635 A 10/1999 Dakhil ..... 62/78
6,205,814 B1 3/2001 Dakhil ..... 60/651
6,349,787 B1 2/2002 Dakhil ..... 180/302

* cited by examiner

*Primary Examiner*—Sheldon J. Richter
(74) *Attorney, Agent, or Firm*—Merchant & Gould P.C.

(57) ABSTRACT

A power plant for a use device wherein liquid nitrogen and a heated transfer fluid are alternately used to expand and contract a liquid metal like mercury to drive a piston, a crankshaft, and subsequent drive apparatus. A control device is timed with operation of the piston to control various solenoid valves and pumps to cause liquid nitrogen to flow into a jacket around a reservoir containing the liquid metal thereby causing it to cool and move the piston in a return stroke. When appropriate, the heated transfer fluid is pumped into a different enclosure of the jacket to force out remaining nitrogen and thereby to heat the liquid metal and move the piston in a power stroke. The process continues so as to provide continuous power to the use device.

4 Claims, 3 Drawing Sheets

LIQUID METAL/LIQUID NITROGEN POWER PLANT FOR POWERING A TURBINE OR ANY USE DEVICE

FIELD OF THE INVENTION

A power plant for a use device wherein liquid nitrogen and a heated transfer fluid are alternately used to expand and contract a liquid metal like mercury to drive a piston and subsequent drive apparatus.

BACKGROUND OF THE INVENTION

Automobiles and various industries emit pollutants including sulfur compounds, carbon and nitrogen oxides, and are causing an ever increasing global warming, as well as hazardous health problems on the planet, and this is becoming the world's most dangerous and preoccupying matter. The rapid increase in demand for automobiles in the world and particularly in Asia, a demand which has doubled in the last four years, requires an urgent solution. The earth's population is continuously increasing all of which requires more energy and puts huge pressure on the world community to find reliable but clean solutions in this regard.

I have proposed some concepts in a series of patents/inventions so far to address this subject matter in the hope of finding a satisfactory solution. This present invention is a continuation of this effort to find a global solution to the problem of global warming and pollution in such a way that it would encompass the whole cycle of energy which is produced from non-polluting, renewable energy sources from the beginning of the cycle of energy, that is, from the plant which provides fuel through to a zero-emission vehicle. So far, vehicles powered by electric motors, fuel-cells, or hybrid vehicles have not been satisfactory because they have placed the pollution problem back where it is at the starting point of the cycle of energy, that is, at the power generation plant which supplies required energy to charge batteries for electrical cars or at the power generation plant which produces hydrogen from natural gas in the case of fuel-cells.

In my U.S. Pat. No. 6,349,787, "A Vehicle Having a Turbine Engine and a Flywheel Powered by Liquid Nitrogen", and my U.S. Pat. No. 6,205,814, "Apparatus and Method for Producing Liquid Nitrogen", I have tried to disclose a complete energy cycle system. I am aware of the huge task and effort needed to be addressed to introduce these systems to the world. Nevertheless, my innovations are possible. At the liquid nitrogen producing facility, I have suggested a new concept of using mercury expansion to replace gas turbines and/or diesel generators to produce the actual fuel (liquid nitrogen) needed for vehicles. That is, the disclosures of both patents work together with respect to the complete cycle of energy.

As a further example of my thinking, my U.S. Pat. No. 5,960,635 "Air Conditioning Apparatus using Liquid Nitrogen" is also an effort to reduce pollution in the atmosphere by replacing pollutant CFC used generally in air-conditioning, which is enlarging the ozone hole in the stratosphere of the planet, by liquid nitrogen, which is a clean and renewable source of energy. If we really want to solve the environmental problems, we need to go back to where the whole cycle of energy starts. There is no way to solve the pollution problem on earth without tackling the initial part of the cycle of energy. We might need to do some sacrifice because of the low energy density of such new systems. That is, we may not be able to travel as fast as gasoline vehicles, but if we look at the actual need for vehicles in towns and cities, the tendency is to go 20–50 miles per hour which could be easily achieved by a pollution-free vehicle and, thus, at no cost to our health and using a much cheaper renewable source of energy-liquid nitrogen. On the other hand, if we want to go 300 miles per hour, a speed which is practically unreasonable on city streets and even on highways, we will pay with our health quite dearly. Thus, I have tried in the present invention to consider some of my earlier concepts in order to develop a satisfactory power plant and vehicle that would be pollution-free and yet be competitive with gasoline vehicles and conventional power plants.

SUMMARY OF THE INVENTION

The present invention is based on my earlier invention of U.S. Pat. No. 6,205,814, "Apparatus and Method for Producing Liquid Nitrogen" in which I proposed using liquid mercury, due to its high expansion coefficient, to drive a piston that would in successive strokes of compression and contraction bring air to a liquid state in order to extract liquid nitrogen from it. The present invention is a modification and novel use of this technology wherein a mechanism is disclosed that would generate power for a use device which could be a vehicle such as a car, a forklift, a ship, a train, a bus or any other device needing power. The present invention is directed to the specification of a power plant apparatus and its mode of operation directly embodied on board a vehicle or on the ground.

More particularly, but in a broad sense, the present invention is directed to a power plant for powering a use device. There is a liquid metal and a substantially incompressible fluid, as well as a fuel tank containing liquid nitrogen. There is also a reservoir containing a transfer fluid for heating the liquid metal. A control system alternately controls the communication of liquid nitrogen from the fuel tank to cool the liquid metal and communication of the transfer fluid from its reservoir to heat the liquid metal thereby causing the liquid metal to contract and expand and thereby moving the incompressible fluid to drive a piston. The piston is operably installed to drive a crankshaft which in turn powers the use device.

DETAILED DESCRIPTION OF THE PREFERRED EMBODIMENTS

Figure 1:
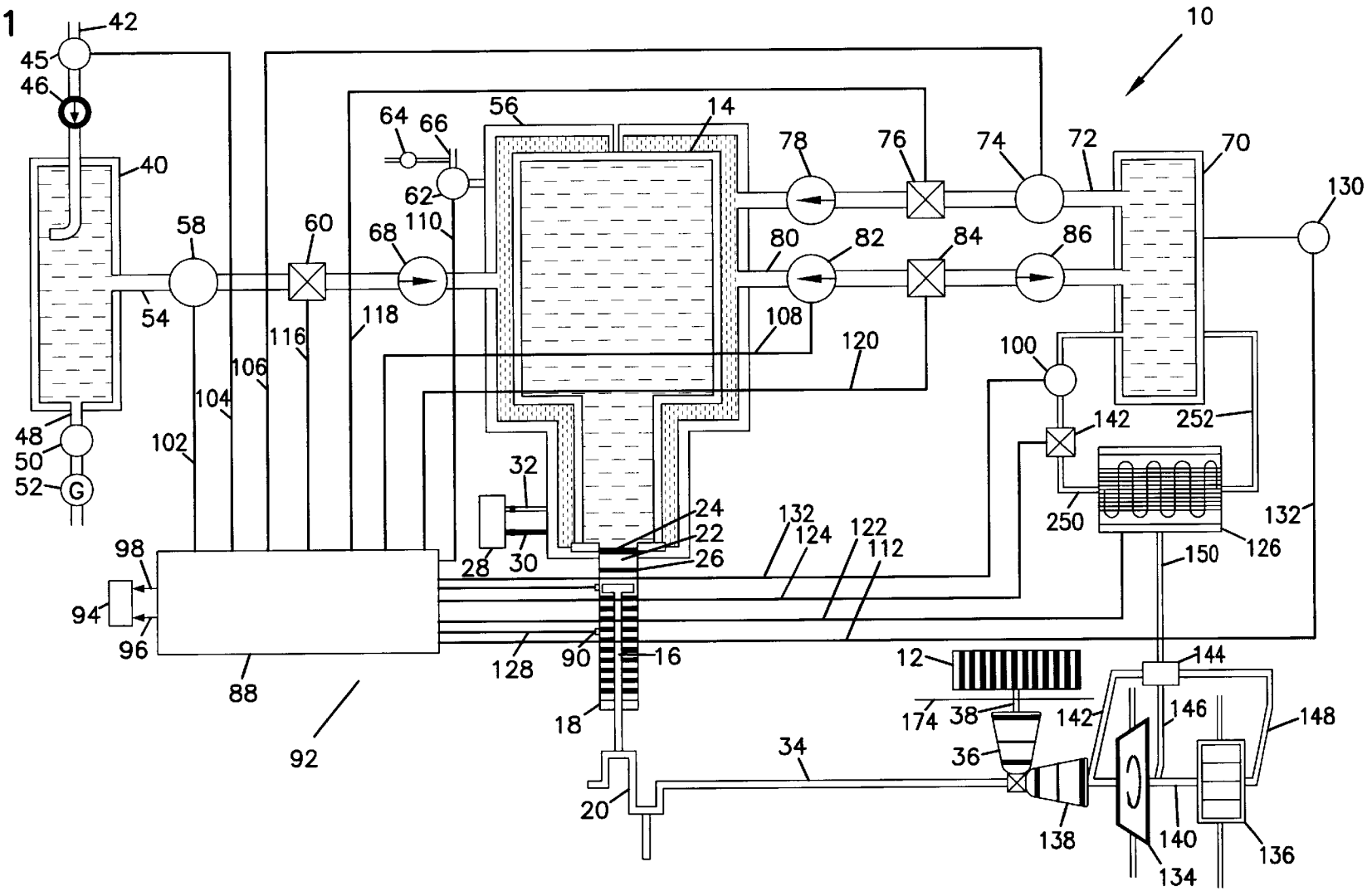
FIG. 1 is an illustration which depicts schematically the power plant invention for powering a use device.

With reference to the drawings wherein like parts are designated by the same numerals throughout, a power plant in accordance with the present invention is designated generally by the numeral 10. With reference to FIG. 1, power plant 10 is illustrated with use device 12.

Power plant 10 has a reservoir 14 of a liquid metal, like mercury, which can expand and contract. As a result of the expansion and contraction of the liquid metal, a piston 16 in cylinder 18 drives a crankshaft 20. First reservoir 14 is fully-enclosed and filled with the liquid metal.

More particularly, first reservoir 14 is connected with second reservoir 22. Second reservoir 22 is essentially an extension from cylinder 18 and in fluid communication with cylinder 18. Second reservoir 22 is filled with a substantially incompressible fluid, like oil. A separator 24 which is flexible and attached in a sealing fashion at its edge or edges separates the liquid mercury and the incompressible fluid from one another while allowing the liquid mercury and the incompressible fluid to have the same pressure. A valve system 26 between second reservoir 22 and cylinder 18 allows passage of the incompressible fluid in both directions as appropriate so as to move piston 16 in suction and compression strokes as the liquid metal contracts and expands, respectively. Valve system 26 is essentially another separator which has a one-way valve in one direction and a one-way valve in another direction. An expansion chamber 28 is in fluid communication through a valved inlet line 30 and a valved outlet line 32 with second reservoir 22. The valves in lines 30 and 32 are pressure controlled relief valves which only open if pressure in second reservoir 22 rises to a predetermined level during expansion or is reduced to a predetermined level during contraction. Thus, when the liquid metal expands, separator 24 allows the liquid metal to flex separator 24 and expand into second reservoir 22 thereby forcing incompressible fluid through valve system 26 to drive piston 16. During contraction of the liquid metal, separator 24 returns to its normal position so that incompressible fluid is drawn through valve system 26 to refill second reservoir 22 and allow piston 16 to move in a return stroke. Piston 16 is operably installed to drive crankshaft 20. Crankshaft 20 provides rotational motion through shaft 34 to transmission 36. Transmission 36 drives use device 12 via shaft 38. The mechanical drive from piston 16 to use device 12 is conventional.

First reservoir 14 is a container conventional, for example, of unbreakable synthetic glass (e.g. plexiglas), stainless steel, aluminum, and the like, which are efficient conductors of heat energy, for containing a liquid metal like mercury. A wall of the container includes a boss and appropriate elements for fastening separator 24 and second reservoir 22 thereto. Such fastening elements are also conventional.

Liquid nitrogen is the intended fuel for power plant 10. Liquid nitrogen is filled into fuel tank 40 through pipe 42. Solenoid valve 44 is opened to allow fuel to be pumped through check valve 46 into fuel tank 40. When tank 40 is sufficiently filled, solenoid valve 44 is closed.

Fuel tank 40 is an insulated pressure tank, such as a dewar flask, constructed to safely receive liquid nitrogen. Liquid nitrogen has a boiling point of minus 320° F. and a vapor pressure of 150 psg. Pipe 48 is provided to allow the release of gases and pressure in fuel tank 40 during liquid filling, including the release of moisture. Relief valve 50 and pressure gauge 52 control and provide information regarding appropriate release.

Pipe 54 provides fluid communication of liquid nitrogen from fuel tank 40 to a jacket 56 around first reservoir 14. Pipe 54 includes a solenoid valve 58, a pump 60, and a check valve 62. When fuel is called for as described further below, pump 60 turns on and solenoid valve 58 opens. When liquid nitrogen is no longer needed to cool the liquid metal, pump 60 turns off and solenoid valve closes. Relief valve 64 ensures that pressure does not exceed the design limits of the walls containing jacket 56. Relief valve 64 is branched off exhaust pipe 66 which includes solenoid valve 68. For example, when nitrogen changes state from a liquid to a gas, the expansion rate could reach 720 to one and the pressure increase and pressure on gas flowing to the flywheel 134 or turbine engine 136 could reach 300 psig.

Throughout the disclosure, check valves are conventional one-way valves providing flow toward a destination and preventing flow back from the destination. Pumps are conventional for pumping the particular fluid and have sufficient capacity for the design purpose. Likewise, solenoid valves are conventional, as are relief valves.

A third reservoir 70 contains a transfer fluid for heating the liquid metal in first reservoir 14. The transfer fluid is preferably a very light oil, but could even be water. Pipe 72 provides fluid communication of the transfer fluid from third reservoir 70 to jacket 56 through solenoid valve 74, pump 76, and check valve 78. Pipe 80 provides fluid communication of transfer fluid back from jacket 56 to third reservoir 70 through solenoid valve 82, pump 84, and check valve 86.

Third reservoir 70 is a conventional container suitable for the transfer fluid being used with design parameters appropriate for the extremes of pressure and temperature of the transfer fluid.

Heating device 126 is in fluid communication via pipe 250 through solenoid valve 100 and pump 114. Pipe 252 provides fluid communication from heating device 126 back to third reservoir 70. The temperature of the transfer fluid in third reservoir 70 is monitored at thermometer 130. When it is necessary to heat the transfer fluid, solenoid valve 100 is turned on and pump 114 is also turned on to pump transfer fluid through pipe 250, heating device 126, and pipe 252. Heating device 126 is conventional and can include resistive heating elements, heat exchange elements, and the like. Alternatively, heating device 126 can receive some or all of the heat needed to heat the transfer fluid from excess heat appropriately carried away from transmission 138, fly wheel 134, and/or turbine engine 136, as appropriate depending on the embodiment that is discussed further here below. The intent is that the heat gained from the compression work of piston and all other frictional heat generated in the system is to be utilized and recycled to the third reservoir 70, and as discussed herein to the liquid metal/mercury first reservoir 14 in a feed back process system. The elements of this kind of coordinated recycling system are known to those experienced in the state of the art.

Jacket 56 is a double enclosure bladder of rubber or other flexible material which is compatible with liquid nitrogen and the transfer fluid. Liquid nitrogen is pumped into jacket 56 to fill one of the enclosures in the bladder. As liquid nitrogen flows in, it forces the heated transfer fluid in the other enclosure of the bladder out and back to third reservoir 70. The liquid nitrogen cools the heated liquid metal and causes it to contract. As the liquid nitrogen takes on heat from the heated transfer fluid that it forces out and also from the heated liquid metal, the liquid nitrogen vaporizes and exhausts through relief valve 64 and/or solenoid valve 68 directed to flywheel 134 before going to exhaust pipe 66. Thus, all energy generated in the system (that is, by liquid nitrogen changing to gaseous form and expanding to do work) is conserved and efficiently utilized. When it is time during the power cycle to cause the liquid metal to expand, the heated transfer fluid is pumped from third reservoir 70 into the appropriate enclosure of jacket 56. The heated transfer fluid forces out any remaining liquid nitrogen which has now vaporized. The heated transfer fluid heats the liquid metal and causes it to expand. The cycling of cooling the liquid metal and then heating it and then cooling it again continues and is controlled by control device 88 as it controls the various solenoid valves and pumps. Sensor 90 senses the location of piston 16 which then provides a timing mechanism between the mechanical system of the piston and crankshaft and the electronic system of the control device and various solenoid valves and pumps. The logic of the control system is known to those skilled in the art based on the present disclosure and the particulars of such control system are not otherwise important to the present invention disclosed.

For purposes of the present disclosure, control system 92 is schematically illustrated with respect to the rest of power plant 10. Control system 92 has a control device 88, as indicated, powered by connections ultimately made with battery 94 as illustrated by wires 96 and 98. Control system 92 through control device 88 controls the various solenoid valves 58, 44, 74, 82, 68, and 100 as illustrated by lines 102, 104, 106, 108, 110, and 112, respectively. Also control system 92 controls pumps 60, 76, 84, and 114 as illustrated by lines 116, 118, 120, and 122, respectively. Line 124 illustrates control of heating device 126. Sensing device 90 communicates with control device 88 as illustrated by line 128.

Third reservoir 70 contains the transfer fluid. The transfer fluid is maintained at a particular temperature as monitored by thermometer 130. The temperature information is communicated to control device 88 as illustrated by line 132.

In an alternate embodiment, power plant 10 may include a flywheel 134 and/or a turbine engine 136. Flywheel 134 and/or turbine engine 136 are mechanically interconnected with crankshaft 20 and use device 12 through coaxial shaft 140 and transmissions 138 and 36. These mechanical interconnections are conventional.

A cooling jacket (not shown) for any one of transmission 138, flywheel 134, and/or turbine engine 136 and/or other sources of heat in power plant 10 can be in fluid communication with the transfer fluid at heater 126 or third reservoir 70. In that way, heat generated at transmission 138, flywheel 134, and/or turbine engine 136 is recovered and used in order to save energy and reduce the energy usage (from battery 94 or other energy source) of heating device 126.

Figure 2:
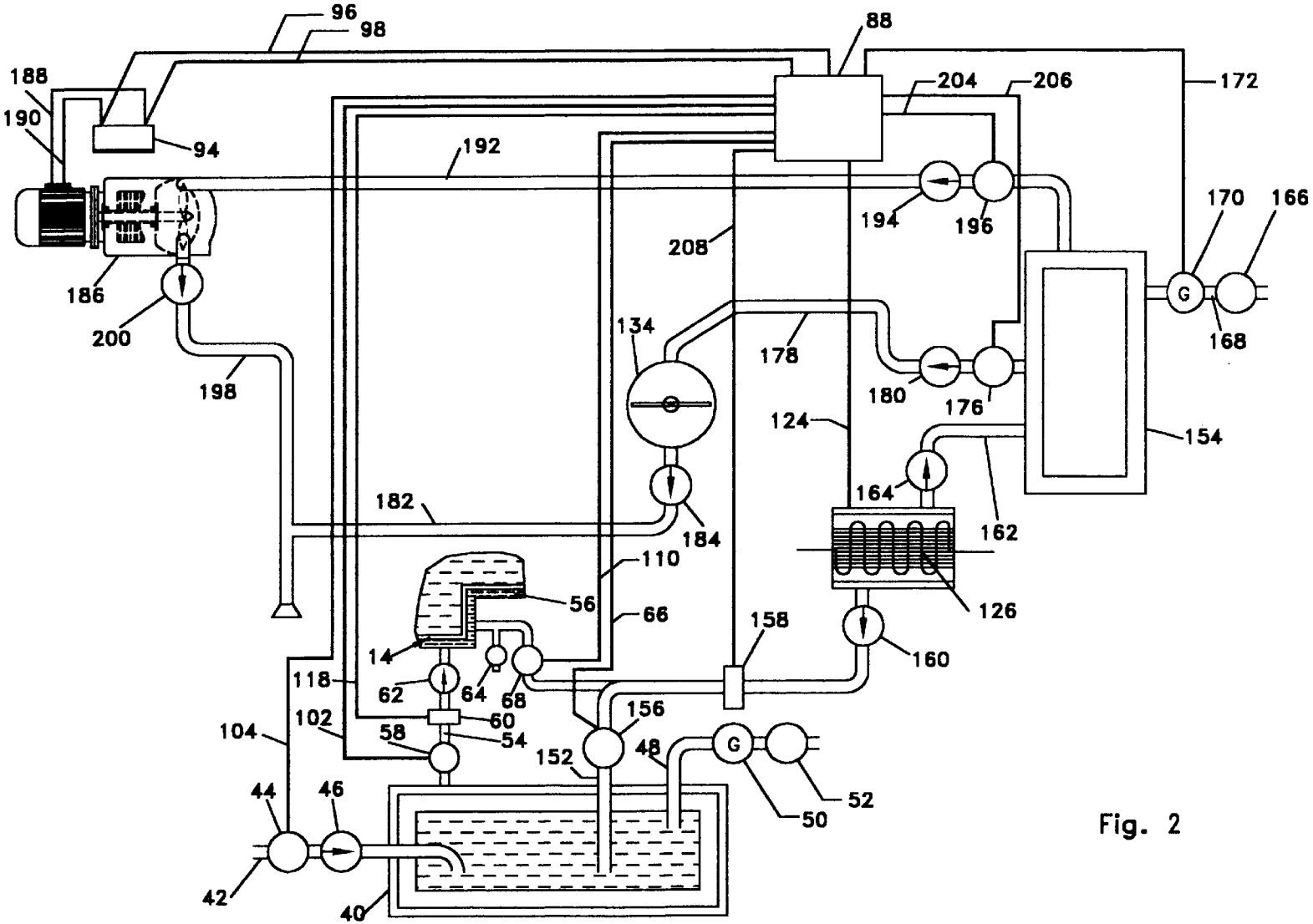
FIG. 2 is an illustration which depicts schematically a second embodiment of the power plant invention in a form which powers a vehicle.

The alternative heat conservation fluid communication system is illustrated by tube 142 connected between the cooling jacket (not shown) of transmission 138 and manifold 144, tube 146 connected between the cooling jacket (not shown) of flywheel 134 and manifold 144, and tube 148 connected between the cooling jacket (not shown) of turbine engine 136 and manifold 144. Tube 150 connects manifold 144 with the fluid transfer system of the transfer fluid in heater 126 or third reservoir 70. Various pumps, valves, plumbing connections, etc., are conventional and are not shown. As indicted, flywheel 134, turbine engine 136 and transmission 138 are optional. In a second embodiment, as shown in FIG. 2, flywheel 134 is incorporated into power plant 10. The apparatus already described in FIG. 1 is a part of the second embodiment, but will not be described again.

Flywheel 134 is driven by pressurized nitrogen. As indicated earlier, liquid nitrogen from second reservoir 40 is pumped into jacket 56 wherein the liquid nitrogen vaporizes and exhausts through solenoid valve 68. Liquid nitrogen can also be provided directly from second reservoir 40 through pipe 152 to heating device 126 and then plenum tank 154. Solenoid valve 156 controls liquid nitrogen flowing from second reservoir 40. Pipes 152 and 66 join at an appropriate fitting. Pump 158 pumps nitrogen as necessary through check valve 160 to heating device 126. Note that heating device 126 can be a single device for heating both the transfer fluid and the nitrogen as necessary or it can be two separate devices.

Heating device 126 may be a heat exchanger and, as previously discussed may include a heating unit electrically powered (not shown) or may be a radiator for receiving atmospheric heat and the like. Heating device 126 nonetheless, has sufficient capability to provide heat to gasify any liquid nitrogen flowing to it and to do so at a capacity level sufficient to provide the expected design performance for the appropriate embodiments of the invention.

Heating device 126 is in fluid communication with plenum tank 154 via pipe 162 through one-way check valve 164.

Plenum tank 154 is a pressurized tank for holding gaseous nitrogen resulting from the gasification of the liquid nitrogen at heating device 126. Plenum tank 154 is also, for example, a dewar flask, or other pressurized vessel known to those skilled in the art, which has an adequate safety rating for the volume and pressure needed to provide the power capacity for the appropriate embodiments in accordance with this invention, and plenum tank 154 is adequately insulated.

Relief valve 166 in fluid communication through pipe 168 with plenum tank 154 prevents pressure from exceeding a safe value. Sensor gauge 170 is monitored via line 172 by control device 88 and when the pressure drops below a predetermined minimum as established by the performance desired for the use device, solenoid valve 156 is opened, pump 158 is turned on, and heater 126 if necessary is also controlled as desired so that additional nitrogen gas is charged into plenum tank 154. Nitrogen from jacket 56 is released through solenoid valve 68 whenever transfer fluid is pumped into jacket 56. Pump 158 at those times allows the nitrogen or pumps as needed the nitrogen on through.

Use device 12 could be one of a plurality of wheels for a vehicle 174 (see FIG. 1). In such case, the wheels could be front wheels or back wheels and are connected by shaft 38 through one or more transmission units 36 and 138 to power devices, namely, crankshaft 20 and/or flywheel 134. There are differential joints and other conventional structures as known to those skilled in the art for operable installation relative to vehicle 174. In this case, the Figures are illustrative only and do not show for the sake of clarity all structures which may be installed and are known to those skilled in the art.

Flywheel 134 is conventional. An acceptable flywheel is disclosed in U.S. Pat. No. 6,349,787. When necessary to provide appropriate power to the use device, solenoid valve 176 is opened so that nitrogen from plenum tank 154 can flow through pipe 178 via check valve 180 to flywheel 134. Nitrogen exhausts through pipe 182 through check valve 184.

Alternator 186 is conventional and includes a turbine-like structure which is driven by nitrogen gas from plenum tank 154. Alternator 186 is electrically wired via lines 188 and 190 to battery 94 in a conventional fashion. Pipe 192 provides fluid communication through check valve 194 when solenoid valve 196 is opened. Nitrogen is exhausted from alternator 186 at pipe 198 through check valve 200.

Solenoid valves 156, 176, and 196, are connected to control device 88 as illustrated by lines 202, 204, and 206, respectively. Pump 158 is connected to control device 88 as illustrated by line 208.

Figure 3:
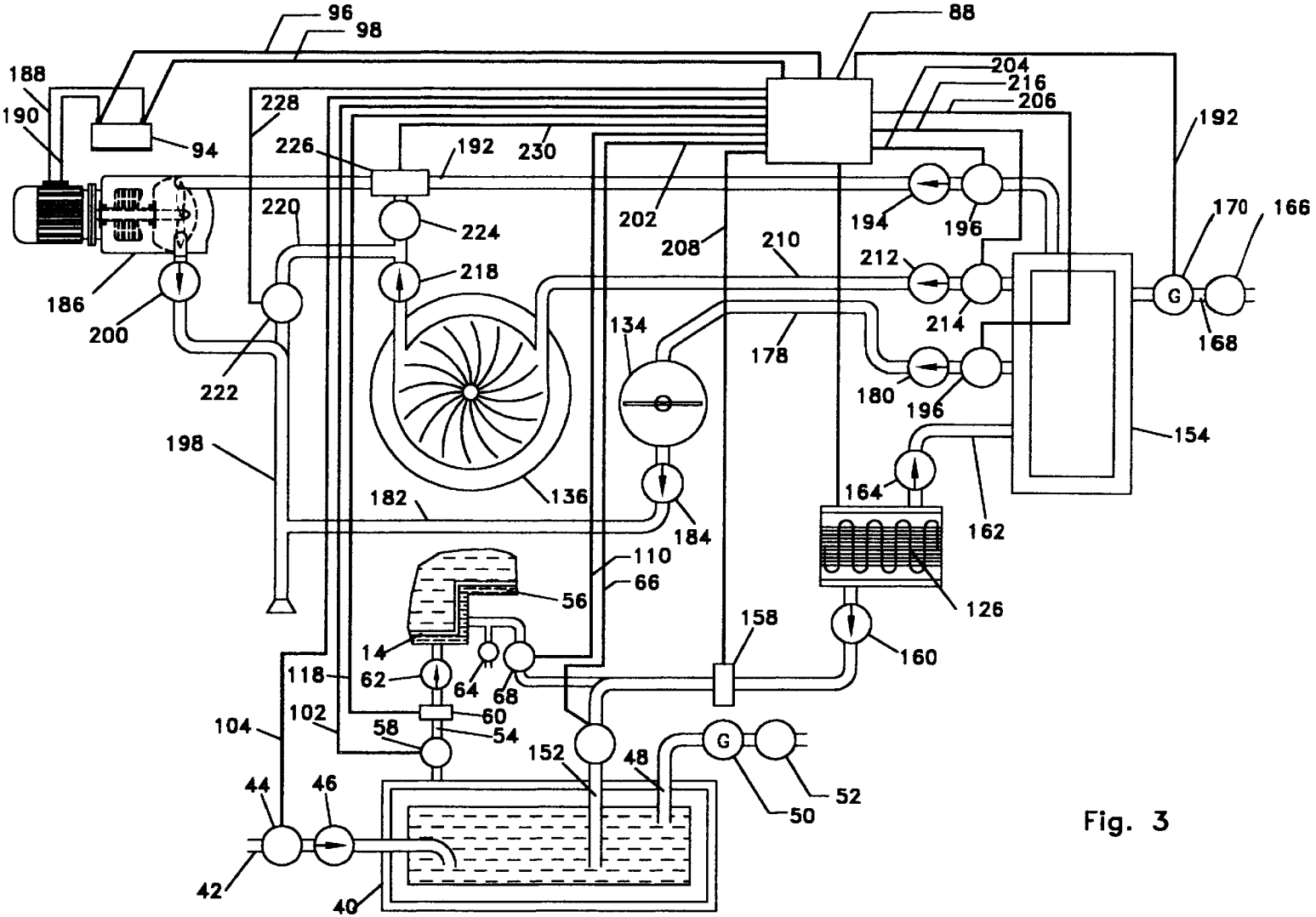
FIG. 3 is an illustration which depicts schematically the power plant invention in a third embodiment in a form for powering a vehicle.

A third embodiment is illustrated with FIGS. 1–3. The third embodiment includes all the features of the second embodiment, as well as turbine engine 136. The turbine engine 136 provides additional power, as needed, for vehicle 174 to drive wheel 12 through one or both transmissions 38 and 138 in conjunction with flywheel 134.

Turbine engine 136 is driven by nitrogen from plenum tank 154. The nitrogen flows through pipe 210 and check valve 212, when solenoid valve 214 is opened. Solenoid valve 214 is controlled by control device 88 as illustrated by line 216. The gaseous nitrogen exhaust from turbine engine 136 flows through check valve 218 through either pipe 220 and solenoid valve 222 to exhaust pipe 198 or, if there is still sufficient energy in the gaseous nitrogen to drive alternator 186, and then it can flow through solenoid valve 224 to tee 226 to alternator 186. Solenoid valves 222 and 224 are controlled by control device 88 as illustrated by lines 228 and 230, respectively.

In operation, power plant 10 is turned on (and off) at control device 88. When power plant 10 is turned on, liquid nitrogen is provided to jacket 56 in order to cool the liquid metal in first reservoir 14. The liquid metal cools thereby contracting and causing through the incompressible fluid piston 16 to move in a return stroke thereby turning crankshaft 20 and providing rotational motion energy to use device 12 through the appropriate parts. At the appropriate time in the timing sequence of the system, control device 88 causes transfer fluid from third reservoir 70 to be pumped into jacket 56 thereby exhausting nitrogen through pipe 66. The transfer fluid heats the liquid metal in first reservoir 14 which causes through the incompressible fluid piston 16 to move in a power stroke thereby driving crankshaft 20 and use device 12. This continues in an appropriate time sequence to drive piston 16 and crankshaft 20, as is well known for piston engines. In this regard, a single piston is illustrated, but it is understood that power plant 10 could comprise a plurality of pistons for driving crankshaft 20.

With respect to the second embodiment, power plant 10 as just described further includes fluid circuitry through heating device 126 and plenum 154 to provide pressurized gaseous nitrogen as controlled by control device 88 to flywheel 134 to maintain it at an appropriate energy level which can be called on as needed to further power use device 12. Also, gaseous nitrogen can power alternator 186 to keep battery 94 appropriately charged.

In a third embodiment, the gaseous nitrogen can further be used to drive a turbine engine 136 to provide further power for use device 12.

In this regard with respect to a vehicle of this type, the flywheel and the turbine are inversely proportional in function. The flywheel's relative speed is inversely proportional to that of the turbine i.e. when the speed of the turbine decreases and goes to almost nil (idle) the flywheel has to be at maximum speed rates and the transmission system (which is a completely variable system of transmission) would immediately activate the flywheel to accelerate the vehicle, when needed, by pressing the "gas" pedal. When almost maximum speed is achieved, the speed transmission system would only then transmit power from the turbine engine to axial shaft 140. Thus the flywheel is accelerated to a maximum when the turbine engine is decelerated and hence storing most of this energy in flywheel during this time. The demands for peak power are supplied by the flywheel and not by the turbine in order to avoid the long stalling problem of turbines seen in applications like in gas turbines. Vehicles turbines cannot satisfy the low rpm and high torque load needs for starting of the vehicle. For this reason the flywheel is necessary to start up the vehicle until it is moving at an optimum speed and only then is the turbine turned on for continuous work to be done.

Finally, even though power plant 10 has been described in detail, it is understood that power plant 10 as disclosed by the various embodiments is only illustrative of the present invention. Alterations of various components and assemblies are possible and likely, and thus, the invention is limited only by the scope of the appended claims and equivalents.

We claim:

1. A power plant for powering a use device, comprising;

a first reservoir fully-enclosed and contains a liquid metal;

a second reservoir fully-enclosed and contains a substantially incompressible fluid;

a fuel tank containing liquid nitrogen for cooling said liquid metal;

a third reservoir containing heated transfer fluid for heating said liquid metal;

a crankshaft driving said use device;

a cylinder and a piston operably installed to drive said crankshaft;

a separator separating said liquid mercury and said incompressible fluid from one another while maintaining said liquid mercury and said incompressible fluid at a same pressure;

a valve system between said second reservoir and said cylinder allowing passage of said incompressible fluid therethrough to move said piston in suction and compression strokes; and a control system controlling alternately communication of liquid nitrogen from said fuel tank to cool said liquid metal and communication of said transfer fluid from said third reservoir to heat said liquid metal thereby causing said liquid metal to contract and expand thereby moving said incompressible fluid to drive said piston, said liquid nitrogen being exhausted after cooling said liquid metal, said fluid from said third reservoir being recycled from cooling said liquid metal back to said third reservoir.

2. A power plant for powering a vehicle with wheels driven by drive apparatus, comprising;

a first reservoir fully-enclosed and containing a liquid metal;

a second reservoir fully-enclosed and containing a substantially incompressible fluid;

a fuel tank containing liquid nitrogen for cooling said liquid metal;

a third reservoir containing heated transfer fluid for heating said liquid metal;

a crankshaft driving said drive apparatus;

a cylinder and a piston operably installed to drive said crankshaft;

a separator separating said liquid mercury and said incompressible fluid from one another while maintaining said liquid mercury and said incompressible fluid at a same pressure;

a valve system between said second reservoir and said cylinder allowing passage of said incompressible fluid therethrough to move said piston in suction and compression strokes; and a control system controlling alternately communication of liquid nitrogen from said fuel tank to cool said liquid metal and communication of said transfer fluid from said third reservoir to heat said liquid metal thereby causing said liquid metal to contract and expand thereby moving said incompressible fluid to drive said piston, said fluid from said third reservoir being recycled from cooling said liquid metal back to said third reservoir;

a heating device for receiving the liquid nitrogen from the fuel tank and from exhausting after cooling said liquid metal and for converting the liquid nitrogen to nitrogen gas;

a plenum tank receiving the nitrogen gas from the heating device;

a fly wheel operably driving said wheels through said drive apparatus;

means for driving the fly wheel with the nitrogen gas from the plenum tank;

a battery; and means for controlling said fly wheel driving means, said controlling means being powered by said battery.

3. A power plant for powering a vehicle with wheels driven by drive apparatus, comprising;

a first reservoir fully-enclosed and containing a liquid metal;

a second reservoir fully-enclosed and containing a substantially incompressible fluid;

a fuel tank containing liquid nitrogen for cooling said liquid metal;

a third reservoir containing a transfer fluid for heating said liquid metal;

a crankshaft driving said drive apparatus;

a cylinder and a piston operably installed to drive said crankshaft;

a separator separating said liquid mercury and said incompressible fluid from one another while maintaining said liquid mercury and said incompressible fluid at a same pressure;

a valve system between said second reservoir and said cylinder allowing passage of said incompressible fluid therethrough to move said piston in suction and compression strokes; and a control system controlling alternately communication of liquid nitrogen from said fuel tank to cool said liquid metal and communication of said transfer fluid from said third reservoir to heat said liquid metal thereby causing said liquid metal to contract and expand thereby moving said incompressible fluid to drive said piston, said fluid from said third reservoir being recycled from cooling said liquid metal back to said third reservoir;

a heating device for receiving the liquid nitrogen from the fuel tank and from exhausting after cooling said liquid metal and for converting the liquid nitrogen to nitrogen gas, said heating deice also heating the transfer fluid in said third reservoir;

a plenum tank receiving the nitrogen gas from the heating device;

a turbine engine;

means for driving the turbine engine with the nitrogen gas from the plenum tank, said turbine engine for operably driving said wheels through said drive apparatus;

a fly wheel operably driving said wheels through said drive apparatus;

means for driving the fly wheel with the nitrogen gas from the plenum tank;

a battery;

means for controlling said turbine engine driving means and said fly wheel driving means, said controlling means being powered by said battery.

4. The power plant in accordance with claim 3 wherein said heating device includes means for heating said transfer fluid with heat energy created in said power plant at said flywheel, said turbine engine, and the like.

* * * * *